US005887968A

United States Patent [19]

Logan

[11] Patent Number: 5,887,968

[45] Date of Patent: Mar. 30, 1999

[54] LIGHT DISTRIBUTION REFLECTOR FOR EXIT SIGNS AND THE ILLUMINATED BY LED ARRAYS

[75] Inventor: Mark Campbell Logan, Doraville, Ga.

[73] Assignee: National Service Industries, Inc., Atlanta, Ga.

[21] Appl. No.: 850,639

[22] Filed: May 2, 1997

[51] Int. Cl.[6] ..... F21V 1/00

[52] U.S. Cl. ..... 362/241; 362/240; 362/241; 362/249; 362/800; 362/812; 40/546; 40/570

[58] Field of Search ..... 362/240, 241, 362/249, 800, 812; 40/546, 570

[56] References Cited

U.S. PATENT DOCUMENTS 5,428,912 7/1995 Grondal et al. ..... 362/800

*Primary Examiner*—Thomas M. Sember
*Assistant Examiner*—John Anthony Ward
*Attorney, Agent, or Firm*—Kenneth E. Darnell

[57] ABSTRACT

A reflector element intended to locate each light emitting diode of an array of light emitting diodes between outwardly angled, reflective surfaces in order to manage the distribution of light within an enclosure of an exit sign or other illuminated sign thereby illuminating a legend-bearing sign panel of the sign, the invention allows compact sign enclosure formation and provides even illumination of sign panels on all legend-bearing face walls of the exit sign even though multiple point light sources such as light emitting diodes comprise the illumination source. The reflector element of the invention is preferably embodied in a U-shaped dual wall configuration with each wall being formed substantially with a plurality of triangular tooth-like projections interspersed with substantially triangular openings, the projections angling outwardly from a reflector base, a series of apertures being formed in the reflector base for receiving the light emitting diodes of the array. The preferred reflector element of the invention is elongated in conformation and used with a linear array of light emitting diodes, each diode lying between projections forming opposing walls of the reflector element and being shaded thereby. The light emitting diode array is preferably located along at least one interior wall of the sign enclosure adjacent at least one of the legend-bearing face walls. The reflector element is particularly useful with relatively diffuse, medium-viewing angle light emitting diodes, the projections of the walls shading each diode acting to reflect light emanating from the diodes upwardly and outwardly of the reflector element and into interior portions of the sign enclosure to illuminate portions of one or more sign panels having at least edge portions disposed adjacent the LED array.

36 Claims, 5 Drawing Sheets

LIGHT DISTRIBUTION REFLECTOR FOR EXIT SIGNS AND THE ILLUMINATED BY LED ARRAYS

BACKGROUND OF THE INVENTION

1. Field of the Invention

The invention relates generally to illuminated signs having multiple point light sources such as light emitting diode arrays as the illumination source for legend-bearing face panels and particularly to reflector structure mountable in relation to such an array for facilitating an even distribution of light within such a sign to improve illumination of the typically translucent legend disposed on such a face panel.

2. Description of the Prior Art

Illuminated signs and particularly exit signs are commonly employed in commercial and industrial situations as well as in multi-unit residential buildings primarily for exit identification. Such signage takes many forms with interior illumination being provided through the use of a variety of illumination sources, an illumination source of particular utility in these energy conscious times being light emitting diodes which require greatly reduced power expenditures for operation. Although light emitting diodes have been used as the illumination source in exit signs and the like for well over twenty years, the use of light emitting diodes as the illumination source in an exit sign or the like continues to have negative aspects due primarily to the low level of illumination provided by a single diode. While developments in the production of light emitting diodes have continued over the years toward greater light-producing levels for these devices, it must still be recognized that LED technology has not improved to the present time to a point where only a few diodes could be employed with the lighting efficiency of, for example, only one or two incandescent or fluorescent lamps such as are also presently used in exit signage and the like. In order to overcome the low light generating capability of presently available light emitting diodes, various approaches have evolved including the use of a relatively large number of spaced apart light emitting diodes in various arrangements or arrays for providing the necessary candle power for satisfactory illumination of the interior of an exit sign such that the legends on face walls of such signs are evenly illuminated according to code requirements or any other reasonable standard of acceptability. In many such signs, light emitting diodes have been arranged in rows corresponding to the configuration of letters or numbers which comprise the legend of the sign. Such arrangements typically produce alternating bright spots and dark spots in the illuminated legend of the sign even when a diffuser material is placed between the light emitting diodes and the legend sheet or plate. The use of diffusing structure and of reflecting structure has also come into practice in efforts to more evenly distribute light within an exit enclosure so that a legend sheet or plate is more evenly illuminated and illuminated with sufficient candle power to provide an illuminated sign of satisfactory utility. As examples, Grondal, in U.S. Pat. No. 5,299,109, and Malita, in U.S. Pat. No. 5,388,357 describe the use of light emitting diodes in exit signs with reflective surfaces being employed to improve light levels within the signs in efforts to more efficiently utilize the candle power available from the light emitting diodes used in these signs. In U.S. Pat. No. 5,469,347, Duve et al provides a retro-fit unit formed of a plurality of linear LED arrays and provided with a reflector panel mounted in opposition to the light emitting diodes in an effort to scatter light within the interior of an exit sign to improve illumination of a translucent legend carried by the exit sign. As an example of similar technology, Sjobom, in U.S. Pat. No. 5,515,253, locates a refractive lens above an array of light emitting diodes in an effort to more efficiently utilize light emitted from an array of light emitting diodes.

The history of light emitting diode usage in exit signs has therefore been and continues to be an attempt to engineer the use of as few diodes as possible combined with diode mounting arrangements, reflector arrangements and diffuser arrangements inter alia which will provide an acceptable illumination level coupled with a desired even illumination within an acceptably compact sign enclosure structure. Recent trends toward placement of linear LED arrays along one or more interior perimetric walls of a sign enclosure has typically been accompanied by objectionable bands of differing brightness levels horizontally across the illuminated legend of such a sign, such signs so lit often failing to meet code requirements for visibility in addition to being aesthetically objectionable. Prior attempts to correct this particular problem have typically involved positioning of the LED array at greater distances outside of the extents of the translucent legend portions of the sign panel, thereby increasing size and cost of the sign enclosure.

The present invention intends improvement upon the prior art by provision of a volumetrically compact sign enclosure evenly illuminated throughout the interior of the enclosure by an array of light emitting diodes preferably disposed along one interior wall of the sign enclosure. Preferably, a linear array of a minimum number of light emitting diodes is disposed along the horizontal "floor" of the exit sign with the light emitting diodes being mounted to a substrate such as a printed circuit board and extending upwardly from the printed circuit board, which board is positioned immediately below the location of the translucent portions of the legend disposed in or on a sign panel or sheet of the exit sign. The invention particularly contemplates use of a reflector element mounted in association with the LED array and being configured to reflect light emanating from the light emitting diodes into the interior of the sign enclosure to maximize efficiency of the light produced by the light emitting diodes and to provide a more even distribution of light within the exit sign enclosure in all interior portions of the sign enclosure. A desirable illumination level and evenness of illumination is therefore provided within the sign enclosure to evenly illuminate the sign legend at an acceptable level of brightness. The advances in the art afforded by the present invention are accompanied by a reduction in the number of light emitting diodes necessary to produce a given illumination level coupled with an ability to provide a compact sign enclosure, manufacturing costs of the exit enabled by the features of the invention thus being held to acceptable levels.

SUMMARY OF THE INVENTION

The invention provides a reflector element intended for mounting within the interior of an exit sign or the like in association with an array of light emitting diodes which are employed within the sign to illuminate a legend-bearing sign panel. A preferred embodiment of the invention takes the form of an elongated reflector element which is U-shaped in section with arms of the "U" diverging outwardly. Each arm of the "U" in three dimensions is seen to form a wall-like structure formed of alternating triangular toothed-like projections and substantially triangular openings between the projections. Light emanating from light emitting diodes disposed between these spaced "toothed" walls is reflected upwardly and outwardly, portions of the light reflecting upwardly through open upper portions of the reflector element and other portions of the light reflecting outwardly through the openings between the toothed-like projections. The reflector element has a base portion mounting the tooth-like projections of each wall, the base portion having openings formed therein through which the diodes extend into the interior of the reflector element and between the tooth-like projections. The reflector element has fastening elements formed thereon which mate with openings formed in a printed circuit board or similar substrate on which the array of light emitting diodes is mounted.

In a preferred embodiment of the invention, the light emitting diodes are formed into a linear array with the diodes being spaced at regular intervals within the array. Each of the light emitting diodes is preferably "shaded" or lies between two of the tooth-like projections, one each of the projections forming a part of each wall of projections between which the light emitting diodes are disposed. Light emanating from the diodes is reflected from the projections and into the interior of the sign and into portions of the interior both near the array and at distances from the array throughout the interior of the sign. Essentially, the light reflected by the tooth-like projections of the reflector element illuminate not only those portions of the sign enclosure which are located in the vicinity of the array but also those portions of the sign enclosure located throughout the enclosure. Light emanating from the light emitting diodes is reflected upwardly and also outwardly by the projections, light reflected outwardly typically passing through the openings in the opposite toothed-wall or being again reflected by the toothed portions in the opposing wall.

The reflector structures of the invention find particular use with relatively diffuse, medium-viewing angle light emitting diodes. Examples of such diodes include the "red" light emitting diode manufactured by Koteco, this diode being particularly useful for production of a "red" legend as viewed from exteriorly of the illuminated sign. High illumination levels of a desirable color are especially produced within the interior of a sign enclosure by relatively diffuse, medium-viewing angle light emitting diodes which are commonly available. The reflector structures of the invention can also be used to advantage with light emitting diodes of other types such as relatively nondiffuse, narrow-viewing angle light emitting diodes and particularly the "blue" diodes manufactured by Nochia Chemical Industries, Ltd.

Use of the reflector structures of the invention allows production of an exit sign enclosure of compact configuration within which desirably bright and even levels of illumination produce an aesthetically acceptable legend illumination as viewed from a usual location of an environmental space of a building. The reflector structures of the invention therefore enable the production of an exit sign of a desirable size and cost and which is capable of exceptional performance. The reflector structures of the invention are susceptible to manufacture with injection molding processes, manufacturing being accomplished with relative ease due to the structural simplicity of the reflector structures. Costs of the present reflector structures are also minimized due to the low cost of the material employed for formation of the reflector structures.

Accordingly, it is an object of the invention to provide a reflector structure usable within the interior of an illuminated sign such as an exit sign or the like to improve illumination of at least one legend-bearing sign panel of the sign.

It is another object of the invention to provide a reflector structure used in association with an array of light emitting diodes or similar multiple point light sources for illumination of a legend-bearing sign panel of an exit sign or similar illuminated sign.

It is a further object of the invention to provide a reflector element usable with an array of light emitting diodes for illumination of a legend-bearing sign panel in an exit sign or similar illuminated sign wherein portions of the reflector structure reflect portions of the light emanating from the light emitting diodes throughout the interior of the sign enclosure to illuminate one or more sign panels having edge portions located adjacent the array, thereby to provide an acceptably bright and even illumination of a translucent legend formed in said sign panel or panels.

Further objects and advantages of the invention will become more readily apparent in light of the following detailed description of the preferred embodiments.

DESCRIPTION OF THE PREFERRED EMBODIMENTS

Figure 1A:
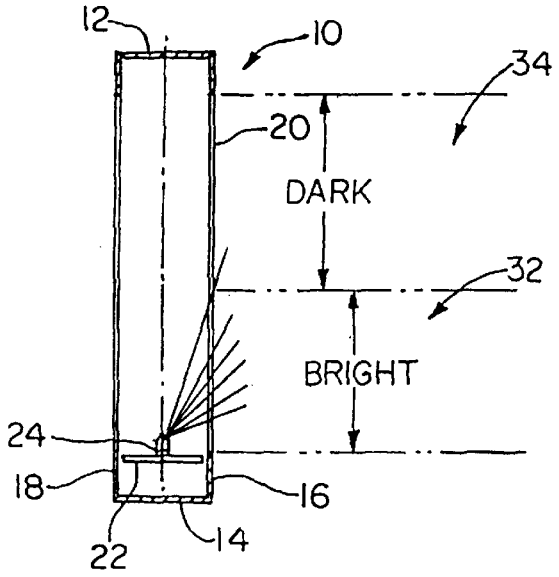
FIG. 1A PRIOR ART
FIG. 1A is a side elevational view of a prior art exit sign utilizing a linear light emitting diode array and illustrating uneven lighting performance typical of the prior art utilizing such an array.
Figure 1B:
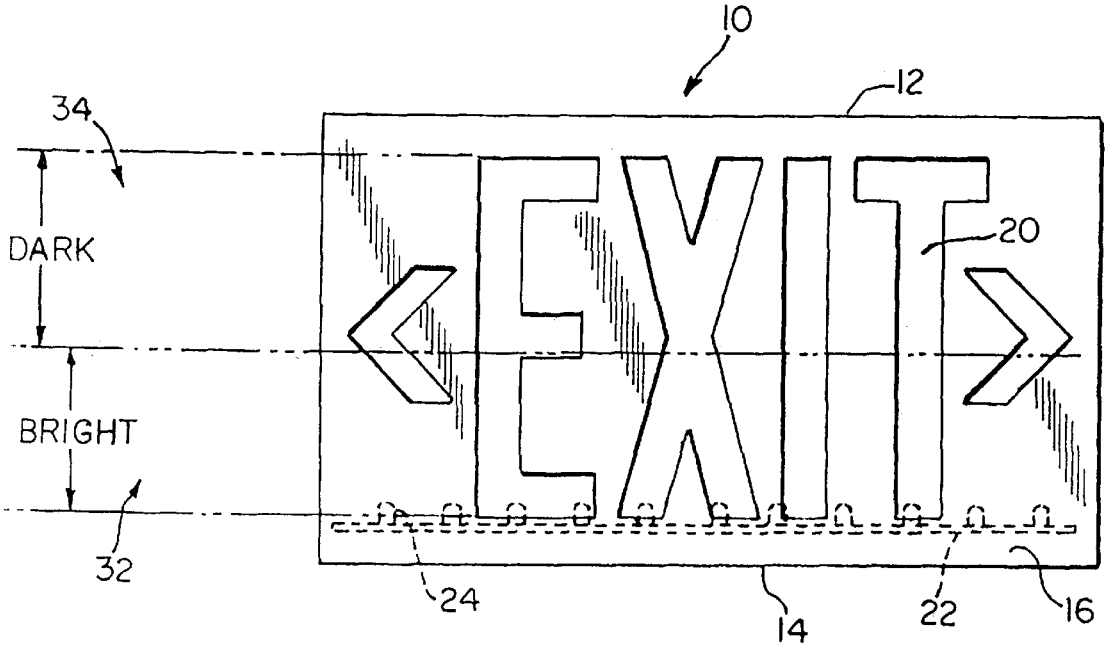
FIG. 1B PRIOR ART
FIG. 1B is a prior art illustration of the exit sign of FIG. 1A seen as a front elevational view and showing uneven light distribution patterns typical of prior art exit signs so configured.

Prior to a description of the preferred embodiments of the invention referenced to FIGS. 2 through 9, a particular problem of the prior art successfully addressed by the present invention can be understood by reference to FIGS. 1A and 1B which illustrate schematically zones of differing illumination in a legend of an illuminated sign such as an exit sign and which typically occur when a light emitting diode array and particularly a linear light emitting diode array is disposed at an interior perimeter surface of an exit sign enclosure such as the "floor" of such an enclosure. With reference to FIGS. 1A and 1B, a prior art exit sign is seen generally at 10 to include top and bottom walls 12 and 14 respectively with legend-bearing wall panels 16 and 18 respectively comprising major planar face portions of the sign 10 between the top wall 12 and the bottom wall 14. In the exit sign 10, letters spelling the word "EXIT" and chevrons disposed on either side thereof comprise legend 20. The legend 20 conventionally takes the form of openings formed in the wall panels 16 and 18. It is to be understood that only one of the legend-bearing panels 16 or 18 would be utilized in the event that the exit sign 10 is to have only one panel intended to be visible such as in a direct mounting of the sign 10 to a wall or the like.

In the prior art exit sign 10, a substrate 22 which can take the form of a printed circuit board or similar dimensionally stable material is disposed within the interior of the exit sign 10 and in spaced relation to interior wall surfaces of the bottom wall 14 by mounting structure which is not shown for convenience. The substrate 22 mounts a plurality of light emitting diodes 24 in a linear array, the diodes 24 being conventionally connected together in a series circuit arrangement. In the prior art, it has been recognized that the substrate 22 bearing the light emitting diodes 24 should be mounted immediately below the lowermost extent of the legend 20 formed in the wall panels 16, 18. By so mounting the substrate 22 and array of the diodes 24, the physical size of the framing structure comprising the exit sign 10 can be as compact as possible. However, the light generating capabilities of the diodes 24 cause significant portions of the light emanating from said diodes 24 to be directed from the interior of the sign 10 through lower portions of the legend 20, thereby producing a relatively bright zone 32 along lower portions of the legend and a relatively dark zone 34 along upper portions of the legend 20. These zones of alternating bright and dark areas are aesthetically objectionable in an illuminated sign and can cause an exit sign in particular to fail code requirements for visibility.

While the exit sign 10 is schematically shown without use of a diffuser panel or sheet disposed over interior wall surfaces of the wall panels 16, 18, the provision of such diffusion panels does not operate to improve upon the objectionable zones 32 and 34 of differing illumination levels. Typical prior art efforts to improve the exit sign 10 involve positioning of the light emitting diodes 24 at locations far outside the extents of the legend 20 on the panels 16, 18, thereby causing the size and cost of the sign enclosure to increase with only modest success in improvement of consistency of legend illumination.

The problem illustrated in FIGS. 1A and 1B is particularly acute when the light emitting diodes 24 are diodes known as diffuse, medium-viewing angle diodes. Use of such diffuse, medium-viewing angle light emitting diodes is particularly problematic when the enclosure forming the exit sign 10 is exceptionally "shallow" or thin relative to the length and height of the exit sign, that is, when the exit sign 10 has dimensions which are referred to in the industry as "low profile" exit signs as is desirable in many use situations. In signage where a "red" legend is intended, "red" light emitting diodes of the relatively diffuse, medium-viewing angle type are often used and are particularly improved by the use of the present reflector structures.

Figure 2:
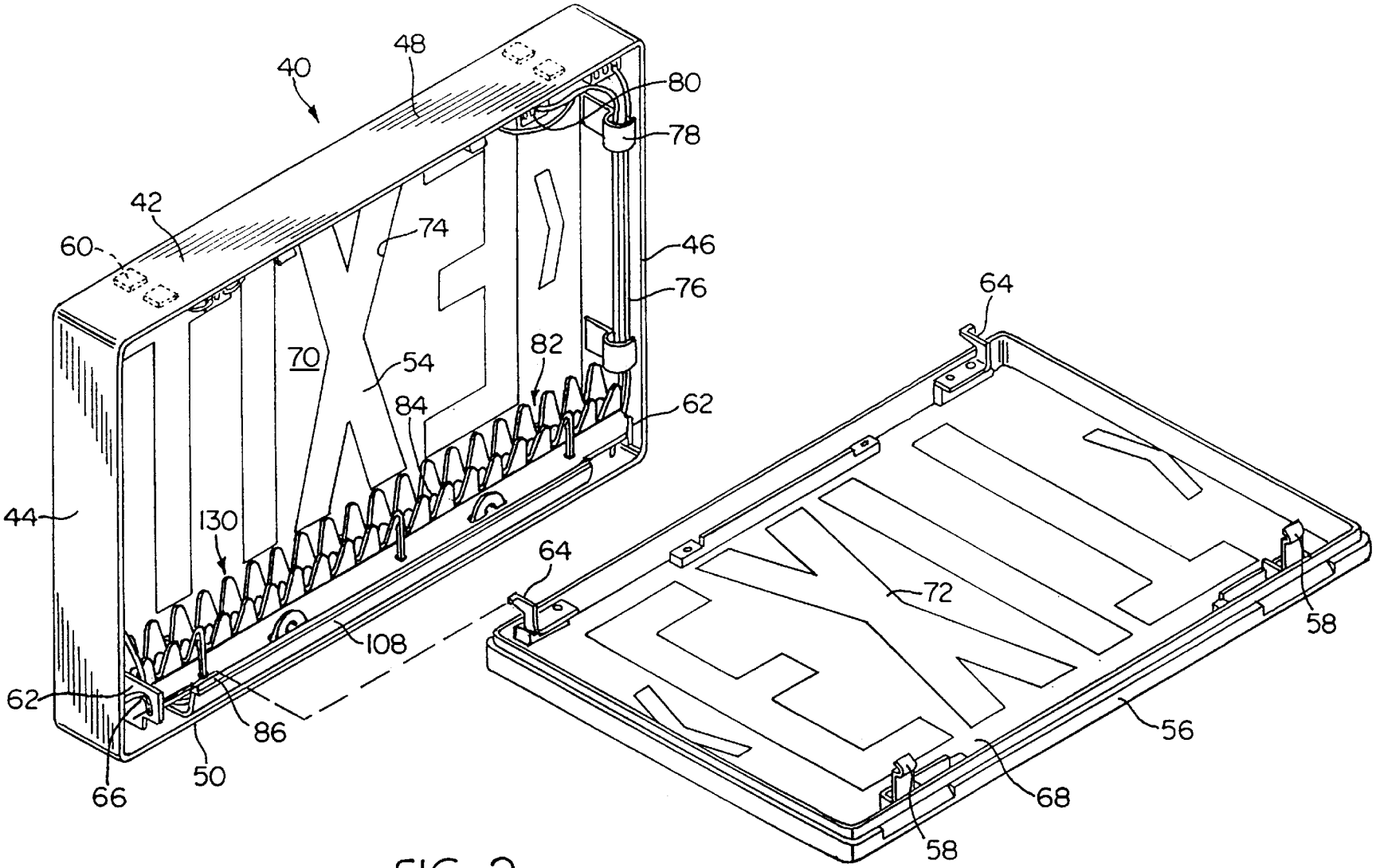
FIG. 2 is a perspective view of an exit sign including a metal die-cast enclosure having a facing panel removed therefrom to illustrate a light emitting diode array and mounting arrangement surmounted by a reflector structure according to the invention, the array and reflector structure being illustrated in a preferred location within the interior of the exit sign enclosure.
Figure 3:
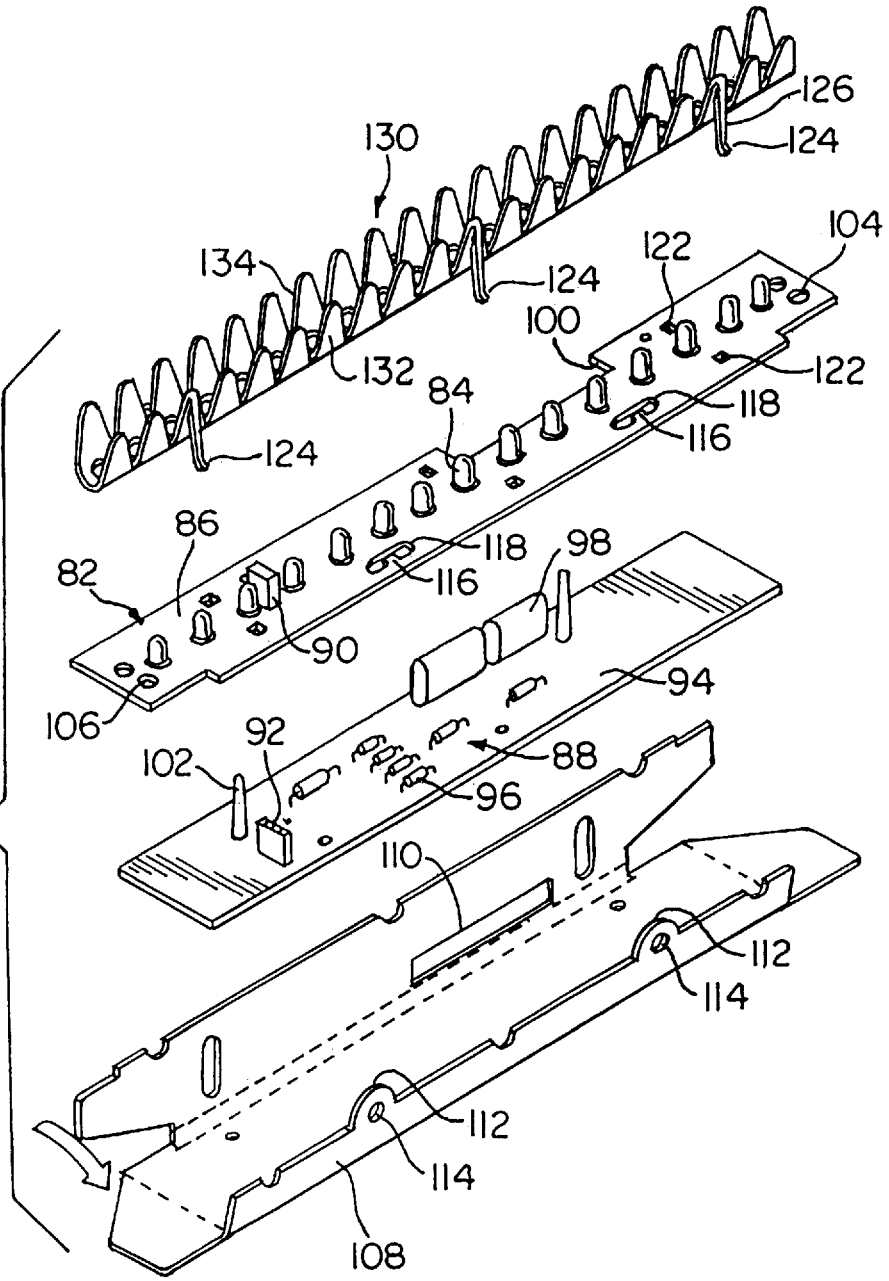
FIG. 3 is an exploded view of the linear light emitting diode array and mounting arrangement of FIG. 2 shown removed from the exit sign enclosure and illustrated in an exploded, assembly view relative to a preferred embodiment of the reflector structure of the invention.
Figure 4:
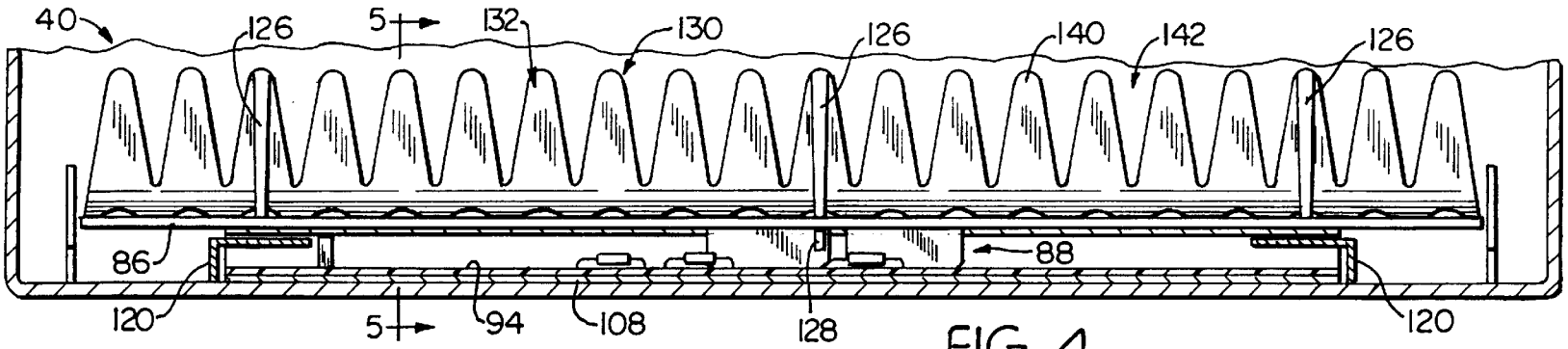
FIG. 4 is a side elevational view in partial section of the light emitting diode array and mounting arrangement in association with the preferred embodiment of the reflector structure of the invention.

Referring now to FIGS. 2 through 9 generally and particularly to FIGS. 2 and 3, an exit sign 40 improved according to the invention is seen to comprise an enclosing frame 42 formed of side walls 44 and 46, a top wall 48 and a bottom wall 50. A planar back wall 52 can be integrally formed as a part of the enclosing frame 42 and can conventionally be formed as a solid plate or as a wall having openings which form a legend 54. A front wall panel 56 is conventionally mounted to the enclosing frame 42 for rapid snap-fitting to the enclosure 42 by means of spring snaps 58 which cooperate with fixed snap lugs 60 (not shown) formed on interior surfaces of the top wall 48 in a conventional manner to snapfit the front wall panel 56 to the enclosing frame 42. The front wall panel 56 pivots along a bottom edge thereof relative to an edge of the bottom wall 50 of the frame 42 through use of conventional brackets 62 fixed to interior surfaces of the bottom wall 50 at either end thereof and cooperating followers 64 mounted to the front wall panel, each follower 64 following a curved track 66 formed in each of the brackets 62 to allow pivoting motion of the front wall panel 56 relative to the enclosing frame 42 and further allowing the front wall panel 56 to be readily removed from the frame 42 and pivoted back onto the, frame 42 as is conventional in the art. The enclosing frame 42 and the front wall panel 56 which effectively comprise the housing of the exit sign 40 can be formed of a variety of materials including die-cast metal and can be formed with decorative surfaces. In the exit sign 40 illustrated, the frame 42 and the panel 56 are formed of aluminum with the outer perimeter of the frame 42 and side perimetric edges of the panel 56 being painted black while facing surfaces of the back wall 52 and of the front wall panel 56 are brushed aluminum in order to provide a desired appearance. Sign panels 68 and 70 are respectively fixed in place over the legend 54 of the back wall 52 and legend 72 formed in the front wall panel 56 as is also conventional in the art. It should be understood that the sign panel 68 would not be used in a modification of the exit sign 40 wherein the legend 54 would not be formed in the back wall 52.

As is also conventional in the art, the legends 54 and 72 essentially comprise openings in planar wall faces of the back wall 52 and the front wall panel 56 respectively. As is also conventional in the art, inner facing surfaces of the sign panels 66 and 68 can be covered with a layer of opaque material such as a layer 74, in order to cover those portions of said panel 68, 70 which are not immediately behind the respective legends 54, 72.

The exit sign 40 as shown is of a kind referred to as a "standard" exit sign which is not operable in the event of failure of standard mains power. The illumination source of the exit sign 40 is operated on AC current through wiring 76 brought into the interior of the sign 40 through a mounting structure (not shown), the wiring 76 connecting circuitry internally of the exit sign 40 to AC mains power. As is also conventional in the art, wire management devices 78 are provided within the interior of the sign 40 to prevent the wiring 76 from inadvertently extending into the interior of the sign enclosure to "shadow" either of the legends 54 or 72. Wire nuts 80 and similar electrical connecting structure can be provided internally of the exit 40 to facilitate electrical operation of the sign 40.

Interior wall surfaces of the exit sign 40 are preferably coated with a reflective material such as white paint, the layer 74 of opaque material formed on the sign panels 68, 70 also preferably being reflective. This reflectivity may be gained by the simple expedient of a coloring of the layer 74 to be a reflective color such as white. Mounting of the exit sign 40 to a structural surface of a building is conventionally accomplished through the top wall 48 or one of the side walls 44, 46.

An array 82 of light emitting diodes 84 is mounted by a printed circuit board 86 in a conventional fashion, the diodes 84 being arrayed in a linear pattern essentially centered on the board 86 and centered within the sign 40 in that plane in which the board 86 lies. It is preferred that the plane of the board 86 be perpendicular to the respective planes within which the back wall 52 and the front wall panel 56 lie so that the diodes 84 are held in a favorable position for illumination of the sign 40. The diode-bearing board 86 is mounted at a location spaced from internal surfaces of the bottom wall 50, the plane of the board 86 being immediately below the lowermost extents of the legends 54, 72 respectively. It is important that the board 86 can be positioned immediately below the lowermost portions of the legends 54, 72 in order to provide not only a desired illumination level and evenness of illumination, but also a compact sign unit. The light emitting diodes 84 are preferably arranged in regularly spaced relation to each other and, for the exit sign 40 shown, the light emitting diodes 84 are seen to comprise non-diffuse, narrow-viewing angle diodes such as "red" diodes manufactured by Koteco under the designation SR 3511. The diodes 84 are mounted to the circuit board 86 in a conventional manner and connect to a circuit shown generally at 88 by means of respective mating electrical connectors 90 and 92, the connector 90 extending through the board 86 and the connector 92 being mounted to a circuit board 94 on which the circuit 88 is mounted. The circuit board 94 is also peferably formed of a printed circuit board material due to dimensional stability as well as dielectric characteristics and the like, the planes in which the respective boards 86 and 94 lie being essentially parallel to each other. The circuit board 94 carries various discrete circuit elements such as diodes 96 comprising a diode bridge, for example, and capacitors 98 to form a circuit which is conventional in the art. The capacitors 98 extend from the surface of the circuit board 94 upwardly through a cutout 100 formed in one edge of the board 86. The circuit board 94 further mounts along an inner edge thereof a spaced pair of plastic mechanical connectors 102 which hold the boards 86 and 94 in spaced relation to each other at least along respective aligned edges. Portions of the wiring 76 extend through apertures 104 and 106 to connect to the circuit 88 mounted by the circuit board 94.

A protective spacer element 108 effectively wraps the circuit board 94 to prevent inadvertent touching of the circuit 88, the element 108 protecting the circuit 88 and also protecting personnel who might inappropriately reach into the interior of the sign 40 without disconnection of power to the circuit 88. The protective spacer element 108 is provided with appropriate openings such as opening 110 to allow upper portions of the capacitors 98 to extend therethrough. The protective spacer element 108 is further formed with spaced tabs.112 formed along a front edge thereof, the tabs each having apertures 114 formed therein for connection to nubs 116 respectively formed in slots 118 disposed in spaced relation to each other and formed in the printed circuit board 86, the tabs 112 respectively extending into the slots 118 from beneath the board 86 with the apertures 114 engaging the nubs 116, the tabs 112 thus being held within the slots 118 thereby to hold the protective spacer element 108 in place and to facilitate maintenance of the printed circuit board 86 in an appropriate level disposition within the interior of the sign 40.

Corner mounts 120 formed on interior wall surfaces of the bottom wall 50 near each end of the wall 50 act to receive ends of the circuit board 94 and lowermost end portions of the protective spacer element 108 to facilitate a desired mounting not only of the board 94 but also of the board 86 on which the diodes 84 are mounted. The protective spacer element 108 is preferably formed of a dense paperboard such as is referred to in the industry as "fish paper". The fish paper material is light in weight, electrically insulative and rigid even though being a thin material.

The board on which the light emitting diodes 84 are arrayed is provided with a series of spaced apertures 122 which receive snap-fitting tabs 124 thereinto for mounting of reflector 130 to the board 86. The tabs 124 are located one each at the distal end of each of leg elements 126 which are integrally formed with primary body portions of the reflector 130. The tabs 124 each have a shoulder 128 which snap-fits up against portions of the underside of the board 86 when the tabs 124 are compressed into the apertures 122. Guide surfaces 129 of the tabs 124 which are disposed adjacent the shoulders 128 act to facilitate a compressive insertion of the tabs 124 into the apertures 122. The leg elements 126 nearmost each end of the reflector 130 are seen to be oppositely disposed to each other, the medial leg elements 126 being offset relative to each other, this arrangement providing a more positive connection of the reflector 130 to the board 86. The reflector 130 is preferably formed of an opaque white "plastic" which is injection molded with fastening structure comprising the leg elements 126 and the tabs 124 being formed integrally with primary portions of the reflector 130.

Figure 6:
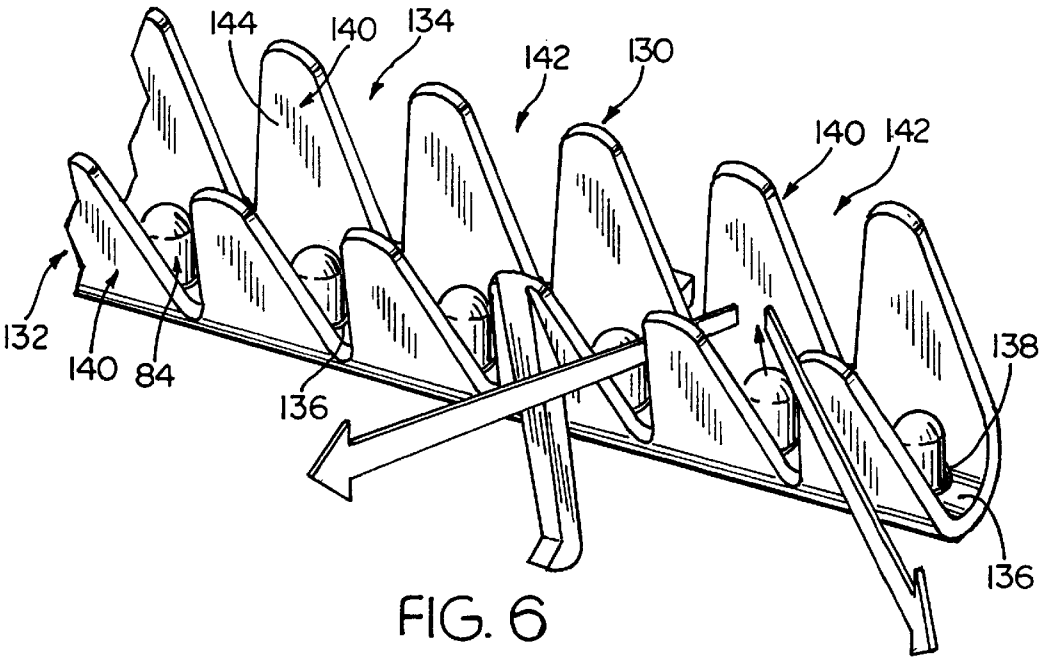
FIG. 6 is an idealized perspective of the reflector.
Figure 5:
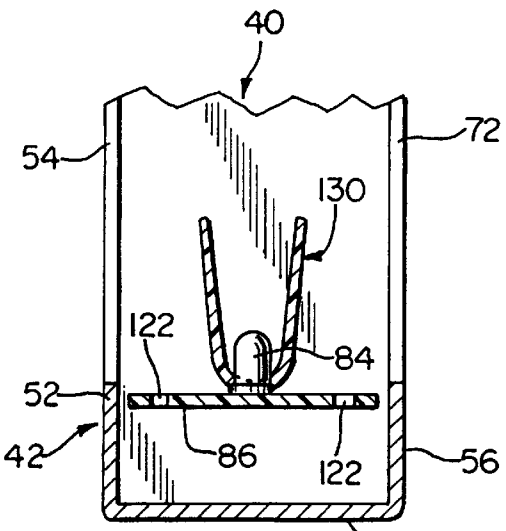
FIG. 5 is an end elevational view in section taken along lines 5—5 of FIG. 4.
Figure 7:
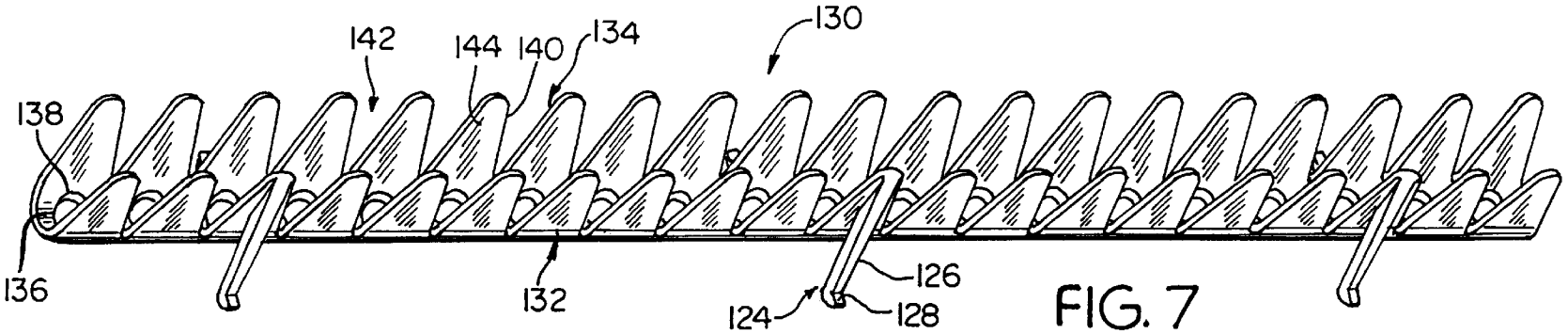
FIG. 7 is a perspective view of the reflector.
Figure 8:
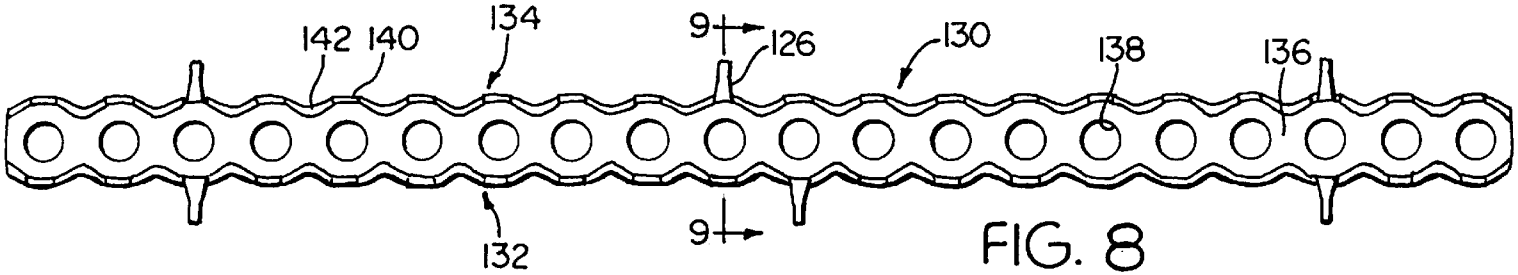
FIG. 8 is a plan view of the reflector of FIG. 7; and, FIG. 9 is a sectional view taken along lines 9—9 of FIG. 8.
Figure 9:
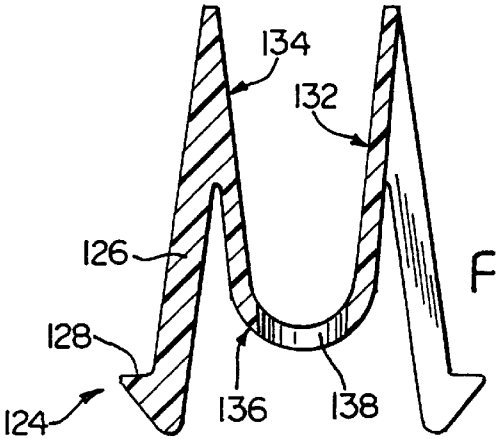

The structure of the reflector 130 is best seen in FIGS. 5 through 9 even though FIG. 6 is an idealized perspective illustrating light reflection from the reflector 130. Essentially, the reflector 130 is U-shaped in section and comprises opposing walls 132 and 134, said walls diverging slightly outwardly toward the upper extents of the reflector 130. The walls 132 and 134 effectively join to a base 136 which essentially forms the "bight" portion of the "U" shaped section. The base 136 is formed with a plurality of apertures 138 spaced from each other along the length of the base 136, the apertures 138 being sized and located to receive one each of the light emitting diodes 84 which are mounted to the board 86. It is to be understood that slot-like apertures (not shown) could be utilized to accommodate more than one of the light emitting diodes 84. The light emitting diodes 84 received within the apertures 138 extend upwardly into the "interior" of the reflector 130 with each diode 84 being aligned with a substantially triangular projection 140 in each of the walls 132, 134. In essence, the walls 132, 134 are each comprised of a plurality of the projections 140 which alternate within each of the walls 132, 134 with substantially triangular openings 142. Each of the projections 140 are substantially planar in conformation with inner surfaces 144 being essentially flat and reflective. The projections 140 are preferably rounded at outermost portions thereof. The openings 142 lying between the projections 140 have greater width at outermost portions of the walls 132, 134 adjacent the rounded portions of the projections 140. The openings 142 are slightly rounded at innermost portions thereof adjacent the relatively wide base portions of the projections 140.

As is particularly illustrated in FIG. 6, light emanating from each of the light emitting diodes 84 is incident upon the reflective inner surfaces 144 of at least one of the projections 140 disposed adjacent to and "shading" each diode 84. A portion of this light incident upon upper portions of the projection 140 can be reflected substantially upwardly into the interior of the exit sign 40. At least some light emanating from each of the diodes 84 passes into the interior of the exit sign 40 without being reflected by the reflector 130. Other portions of the light emanating from the light emitting diodes 84 is incident upon lower and medial portions of the projections 140 and is reflected at differing angles into lower portions of the interior of the exit sign 40 such as those portions substantially adjacent lower portions of the legends 54 and 72. The light reflected at "flatter" angles by the projections 140 essentially pass through the openings 142, the openings 142 causing a number of overlapping relatively bright and relatively dark patterns to be formed with the result being an even distribution of light with minimal use of enclosure space within the exit sign 40. Without the openings 142, the reflector 130 would cast a conspicuous shadow along the bottom of the legends 54 and 72. The overlapping affect thus described is maximized with greater numbers of light emitting diodes and openings for a given length of array. However, the size of a typical exit sign such as the exit sign 40 coupled with cost factors typically allow the use of approximately 20 light emitting diodes within an exit sign. The positioning of each of the diodes 84 between opposing projections 140 in the walls 132, 134, acts to maximize reflection and also to shade the diodes 84 so that said diodes 84 will not appear as brighter spots in the legends 54 and 72.

When the reflector 130 is used with relatively non-diffuse, narrow-viewing angle light emitting diodes, light emanating essentially upwardly and outwardly of free ends of such diodes goes substantially unreflected by the reflector 130 but does act to directly illuminate portions of the sign enclosure spaced at distances from the array 82. Light emanating from diodes at flatter angles is substantially reflected by the projections 140 in a manner similar to that described hereinabove with particular reference to relatively diffuse, medium-viewing angle diodes.

Reflective surfaces disposed interiorly of the exit sign 40 as described herein cause internal reflection of light within the interior of the sign 40 to more evenly illuminate the legends 54, 72 and further to provide a higher level of illumination generally through more efficient utilization of that light produced by the light emitting diodes 84. Accordingly, the zones of relatively dark and relatively bright illumination as seen in FIGS. 1A and 1B of the prior art do not exist in the exit sign 40 due primarily to the provision of the reflector 130 and the functional relationship of the reflector 130 with the diodes 84.

While not limiting of the invention, certain dimensions of the reflector 130 prove particularly useful with the Koteco "red diffused" light emitting diodes referred to herein, these diodes being of the GaAlAs/GaAs type and which have a viewing angle of 50° minimum, 60° nominal and 70° maximum. The luminous intensity of these diodes at 20 mA is 250° to 600° mcd while the peak wavelength is from 650 nM minimum to 670 nM maximum. The height of this diode above the base 136 of the reflector 130 would be less than or approximately equal to 0.173 inch. When using the Koteco diodes thus described, the apertures 138 in the base 136 of the reflector 130 preferably have diameters of approximately 0.25 inch. The reflector 130 would preferably be approximately 1.0 inch in height from the bottom of the base 136 to the full extent of either of the walls 132 or 134. The angle of the openings 142 is approximately 19.4° while the dihedral angle formed by the inner surfaces of the walls 132 and 134 is approximately 12°.

It is to be understood that the reflector 130 can be formed other than as explicitly shown and described herein. Further, the reflector 130 of the invention can be utilized with light emitting diodes of differing type as has been referred to herein. Still further, the reflector 130 of the invention can be employed with light emitting diode arrays other than linear arrays such as the linear array 82 explicitly shown and described herein. Given the teachings provided herein, it is believed that alternative embodiments of the invention can be seen to follow from the explicit embodiments herein detailed, the scope of the invention being limited only by the recitations of the appended claims.

What is claimed is:

1. In an illuminated sign having at least one legend which is to be illuminated from interiorly of the sign for viewing of the legend from a location outside of the sign, the sign including a top wall, a bottom wall, side walls and planar face walls forming a sign enclosure, at least one of the face walls bearing the at least one legend, the interior of the sign enclosure being illuminated by an array of spaced apart point light sources disposed substantially along at least portions of internal wall surfaces of at least one of the top, bottom or side walls, the improvement comprising reflector means disposed adjacent to at least certain of the light sources for reflecting light incident onto surfaces thereof opposing said light sources into the interior of the sign enclosure, the reflector means having reflective surfaces spaced from and adjacent to each of the light sources, openings being provided between the reflective surfaces at locations between said light sources, the interior of the sign enclosure being thus evenly illuminated and thereby evenly illuminating the at least one legend.

2. In the illuminated sign of claim 1 wherein the point light sources comprise light emitting diodes.

3. In the illuminated sign of claim 2 wherein the light emitting diodes are relatively diffuse, medium-viewing angle diodes.

4. In the illuminated sign of claim 2 wherein the light emitting diodes are disposed in a linear array.

5. In the illuminated sign of claim 2 wherein the light emitting diodes are disposed at locations opposing nearmost portions of the at least one legend.

6. In the illuminated sign of claim 2 and further comprising means for mounting the light emitting diodes in a predetermined location within the interior of the exit sign enclosure and for maintaining the light emitting diodes in a fixed location therewithin.

7. In the illuminated sign of claim 6 wherein the mounting and maintaining means comprise a first substrate on which the light emitting diodes are mounted in an electrical circuit, a second substrate carrying circuit elements and being surmounted by the first substrate, means for interconnecting the substrates electrically, and means for interconnecting the substrates mechanically.

8. In the illuminated sign of claim 2 wherein the reflector means comprise at least one reflective wall element disposed between each light emitting diode and portions of the legend adjacent the array, the at least one wall element having open spaces between said wall element and wall elements adjacent thereto, said wall element shading said light emitting diode to prevent said diode from showing as a bright spot in the legend and reflecting at least portions of the light emanating from the diode into the interior of the sign to illuminate the legend.

9. In the illuminated sign of claim 4 wherein the reflector means comprise an elongated base having opposing walls extending therefrom along lengthwise sides of the base, the walls being formed of projections having reflective inner surfaces, the wall having openings formed therein on either side of each projection, at least certain of the light emitting diodes being disposed between opposing projections of the opposing walls, at least portions of the light emanating from each of said at least certain of the light emitting diodes being reflected by the inner surfaces of the projections into the interior of the sign to illuminate the at least one legend.

10. A reflector useful in an illuminated sign or the like which is illuminated by a plurality of point light sources disposed substantially along at least portions of internal wall surfaces of the sign, comprising a body member formed of a base and having a plurality of tooth-like projections having reflective inner surfaces formed along opposing sides of the base, the projections being interdigitated with openings between said projections, the base having a plurality of apertures formed therein, each aperture receiving at least one of the light sources to position said source between opposing projections, at least portions of the light emanating from the source reflecting from the inner surfaces of the projections and into the interior of the illuminated sign to provide more even illumination therewithin.

11. The reflector of claim 10 wherein the light sources comprise light emitting diodes mounted to a substrate, the reflector further comprising means for mounting the body member to the substrate in juxtaposition to the diodes in order that the diodes are received into and through the apertures to extend above the base and into positions between opposing tooth-like projections.

12. In an illuminated sign having at least one legend which is to be illuminated from interiorly of the sign for viewing of the legend from a location outside of the sign, the sign including a top wall, a bottom wall, side walls and planar face walls forming a sign enclosure, at least one of the face walls bearing the at least one legend, the interior of the sign enclosure being illuminated by an array of spaced apart point light sources disposed substantially along at least portions of internal wall surfaces of at least one of the top, bottom or side walls, the improvement comprising reflector means disposed adjacent to at least certain of the light sources for reflecting light incident onto surfaces thereof opposing said light sources into the interior of the sign enclosure, and means for mounting the light sources in a predetermined location within the interior of the sign enclosure and for maintaining the light sources in a fixed location therewithin, the mounting and maintaining means comprising a first substrate on which the point light sources are mounted in an electrical circuit, a second substrate carrying circuit elements and being surmounted by the first substrate, means for interconnecting the substrates electrically, and means for interconnecting the substrates mechanically, the interior of the sign enclosure being thus evenly illuminated and thereby evenly illuminating the at least one legend.

13. In the illuminated sign of claim 12 wherein the point light sources comprise light emitting diodes.

14. In the illuminated sign of claim 12 wherein the mechanical interconnecting means comprise a dielectric wrapper encompassing the second substrate and acting to protect the circuit elements on said substrate, the wrapper having means formed therewith for engaging the first substrate.

15. In the illuminated sign of claim 14 wherein the sign enclosure has mounting means disposed on an interior wall and defining a recess for receiving at least portions of the second substrate and portions of the wrapper to hold portions of the wrapper and of the second substrate in relation to the interior wall, the engaging means formed on the wrapper acting to maintain the first substrate in a location near to and spaced from the interior wall.

16. In the illuminated sign of claim 14 wherein the mechanical interconnecting means further comprise mounting posts interconnecting the first and second substrates and extending therebetween for connection to each of said substrates.

17. In the illuminated sign of claim 12 wherein the point light sources are disposed in a linear array.

18. In the illuminated sign of claim 13 wherein the mechanical interconnecting means comprise a dielectric wrapper encompassing the second substrate and acting to protect the circuit elements on said substrate, the wrapper having means formed therewith for engaging the first substrate.

19. In the illuminated sign of claim 18 wherein the sign enclosure has mounting means disposed on an interior wall and defining a recess for receiving at least portions of the second substrate and portions of the wrapper to hold portions of the wrapper and of the second substrate in relation to the interior wall, the engaging means formed on the wrapper acting to maintain the first substrate in a location near to and spaced from the interior wall.

20. In the illuminated sign of claim 18 wherein the mechanical interconnecting means further comprise mounting posts interconnecting the first and second substrates and extending therebetween for connection to each of said substrates.

21. In the illuminated sign of claim 12 wherein the reflector means comprise reflective surfaces spaced from and adjacent to each of the light emitting diodes, openings being provided between the reflective surfaces at locations between adjacent diodes.

22. In an illuminated sign having at least one legend which is to be illuminated from interiorly of the sign for viewing of the legend from a location outside of the sign, the sign including a top wall, a bottom wall, side walls and planar face walls forming a sign enclosure, at least one of the face walls carrying the at least one legend, the interior of the sign enclosure being illuminated by an array of spaced apart point light sources disposed substantially along at least portions of internal wall surfaces of at least one of the top, bottom or side walls, the improvement comprising reflector means disposed adjacent to at least certain of the light sources for reflecting light incident onto surfaces thereof opposing said light sources into the interior of the sign enclosure, the reflector means comprising at least one reflective wall element disposed between each point light source and portions of the legend adjacent the array, the at least one wall element having open spaces between said wall element and wall elements adjacent thereto, said wall element shading said point light source to prevent said source from showing as a bright spot in the legend and reflecting at least portions of the light emanating from the source into the interior of the sign to illuminate the legend, the interior of the sign enclosure being thus evenly illuminated and thereby evenly illuminating the at least one legend.

23. In the illuminated sign of claim 22 wherein the point light sources comprise light emitting diodes.

24. In an illuminated sign having at least one legend which is to be illuminated from interiorly of the sign for viewing of the legend from a location outside of the sign, the sign including a top wall, a bottom wall, side walls and planar face walls forming a sign enclosure, at least one of the face walls bearing the at least one legend, the interior of the sign enclosure being illuminated by an array of spaced apart point light sources disposed substantially along at least portions of internal wall surfaces of at least one of the top, bottom or side walls, the improvement comprising reflector means disposed adjacent to at least certain of the light sources for reflecting light incident onto surfaces thereof opposing said light sources into the interior of the sign enclosure, the reflector means comprising an elongated base having opposing walls extending therefrom along lengthwise sides of the base, the walls being formed of projections having reflective inner surfaces, the wall having openings formed therein on either side of said projection, at least certain of the point light sources being disposed between opposing projections of the opposing walls, at least portions of the light emanating from each of said at least certain of the point light sources being reflected by the inner surfaces of the projections into the interior of the sign to illuminate the at least one legend, the interior of the sign enclosure being thus evenly illuminated and thereby evenly illuminating the at least one legend.

25. In the illuminated sign of claim 24 wherein the point light sources comprise light emitting diodes.

26. In the illuminated sign of claim 25 wherein the light emitting diodes are disposed in a linear array.

27. In the illuminated sign of claim 24 wherein the base has a plurality of linearly aligned apertures formed therein for receiving at least one of the point light sources therethrough.

28. In the illuminated sign of claim 27 wherein the point light sources are mounted to a substrate and wherein the reflector means further comprises means for removably mounting the reflector means to the substrate.

29. In the illuminated sign of claim 28 wherein the mounting means are formed integrally with the base and the walls.

30. In the illuminated sign of claim 24 wherein the projections are substantially triangular in conformation.

31. In the illuminated sign of claim 24 wherein the walls diverge outwardly from the base.

32. In the illuminated sign of claim 25 wherein the base has a plurality of linearly aligned apertures formed therein for receiving at least one of the light emitting diodes therethrough.

33. In the illuminated sign of claim 32 wherein the light emitting diodes are mounted to a substrate and wherein the reflector means further comprises means for removably mounting the reflector means to the substrate.

34. In the illuminated sign of claim 33 wherein the mounting means are formed integrally with the base and walls.

35. In the illuminated sign of claim 25 wherein the projections are substantially triangular in conformation.

36. In the illuminated sign of claim 13 wherein the walls diverge outwardly from the base.

* * * * *